US007028740B2

(12) United States Patent
Clarady et al.

(10) Patent No.: US 7,028,740 B2
(45) Date of Patent: Apr. 18, 2006

(54) SELF-ACTIVATING THRESHOLD DOOR SEAL

(75) Inventors: Michael J. Clarady, Wichita, KS (US); Lance A. Cutler, Maize, KS (US); John A. Bitker, Wichita, KS (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/637,966

(22) Filed: Aug. 8, 2003

(65) Prior Publication Data

US 2005/0028462 A1 Feb. 10, 2005

(51) Int. Cl.
*E06B 1/04* (2006.01)

(52) U.S. Cl. ..... 160/206; 160/40; 49/303; 49/304; 52/211; 52/656.4

(58) Field of Classification Search ..... 52/204.1, 52/211, 656.2, 656.4, 745.16; 49/303, 304, 49/306; 160/40, 199, 206
See application file for complete search history.

(56) References Cited

U.S. PATENT DOCUMENTS

| | | | | | |
|---|---|---|---|---|---|
| 19,673 | A | * | 3/1858 | Bigelow | 49/304 |
| 103,302 | A | * | 5/1870 | Covey et al. | 49/304 |
| 133,207 | A | * | 11/1872 | Curtis | 49/304 |
| 725,052 | A | * | 4/1903 | Dillon | 49/304 |
| 1,485,208 | A | * | 2/1924 | Altman et al. | 49/304 |
| 1,802,834 | A | * | 4/1931 | Reed | 49/304 |
| 2,066,188 | A | * | 12/1936 | Reese | 49/307 |
| 2,441,073 | A | * | 5/1948 | Keen | 49/304 |
| 2,829,405 | A | * | 4/1958 | Huff | 49/304 |
| 4,438,605 | A | * | 3/1984 | DeLucia | 52/71 |
| 4,709,038 | A | * | 11/1987 | Kay et al. | 546/316 |

OTHER PUBLICATIONS

Wyatt, Mason, Leading Edge Solutions for Noise Control, http://www.noisecontrol.net/doorbottoms.htp, 4 pages, Noise Control by Mason Wyatt, New York, NY.

* cited by examiner

*Primary Examiner*—Peter M. Cuomo
*Assistant Examiner*—Joe Edell
(74) *Attorney, Agent, or Firm*—Thomas F. Lebens; Fitch, Even, Tabin & Flannery

(57) ABSTRACT

An apparatus for providing a smoke barrier through a doorway comprising a door coupled to a doorframe and a threshold on the floor between the doorframe. A movable seal assembly is coupled to the threshold and a first seal is coupled to the doorframe for contacting a top and two sides of the door when the door is in the closed position. A bottom seal is coupled to the movable seal assembly for contacting a bottom of the door when the door is in the closed position.

14 Claims, 14 Drawing Sheets

SELF-ACTIVATING THRESHOLD DOOR SEAL

BACKGROUND OF INVENTION

1. Field of the Invention

The present invention relates generally to door seals. More specifically, but without limitation thereto, the present invention relates to a movable door seal.

2. Discussion of the Background Art

In many environments, e.g., on an airplane, two separate areas may need to be sealed off from one another by smoke and flame barriers while still providing access between the two areas. This helps prevent the spread of fires and also keeps smoke from spreading from the first area to the second area if there is smoke in the first area. This can be especially important in airplane, boats, or other areas where a large number of people are confined to small spaces or in situations where escape from a fire may not be easy. For example in one situation this may prevent the spread of fire or smoke from a storage area or area where there are no people to an area highly populated with people such as the passenger compartment of an airplane. Preventing smoke from a fire in the storage area from reaching the passenger compartment may save a large number of lives as inhalation of smoke is many times the largest cause of death in a fire. Therefore, if a doorway is provided between the two areas it must be sealed on all four sides of the door so that no smoke or flames can penetrate through the closed door.

One prior design for a doorway which acts as a smoke and flame barrier provides a door frame on all four sides of the door. In this design the seal for the door can either be placed on the door itself or on the door frame. One problem with this design is the door frame at the bottom of the door must be higher than the floor. This is because the door needs to open and close properly and also contact the door frame at the bottom of the door so that a smoke tight seal can be made. This can be a major safety hazard as the door frame at the bottom of the door is a trip hazard for anyone passing through the doorway. This can be a source of liability and danger, especially in situations where the public or employees will be using the doorway.

Thus there is a need for a sealing mechanism that addresses the problems above, as well as others.

SUMMARY OF INVENTION

The present invention advantageously addresses the needs above as well as other needs by providing a retractable sealing mechanism coupled to a threshold of the doorway.

In one embodiment the invention includes an apparatus for providing a seal at the bottom of a door comprising a threshold below the door; a movable seal assembly coupled to the threshold; and wherein the movable seal assembly retracts towards the threshold as the door is opened.

In a further embodiment the invention includes an apparatus for providing a sealing mechanism at the bottom of a door comprising a threshold; a movable seal assembly coupled to the threshold; and means for moving the seal assembly to a retracted position upon opening of the door.

In a subsequent embodiment the invention includes an apparatus for providing a smoke barrier through a doorway comprising a door coupled to a doorframe; a threshold on the floor between the doorframe; a movable seal assembly coupled to the threshold; a first seal coupled to the doorframe for contacting a top and two sides of the door when the door is in the closed position; and a bottom seal coupled to the movable seal assembly for contacting a bottom of the door when the door is in the closed position.

In another embodiment the invention includes a method for providing a door without a trip hazard while still providing a smoke and flame barrier comprising sealing a door at a top of the door with a top seal; sealing the door at two sides of the door with a side seal; sealing the door at a bottom of the door with a bottom seal; and retracting the bottom seal downward when the door is opened.

BRIEF DESCRIPTION OF DRAWINGS

The present invention is illustrated by way of example and not limitation in the accompanying figures, in which like references indicate similar elements, and in which.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Figure 1:
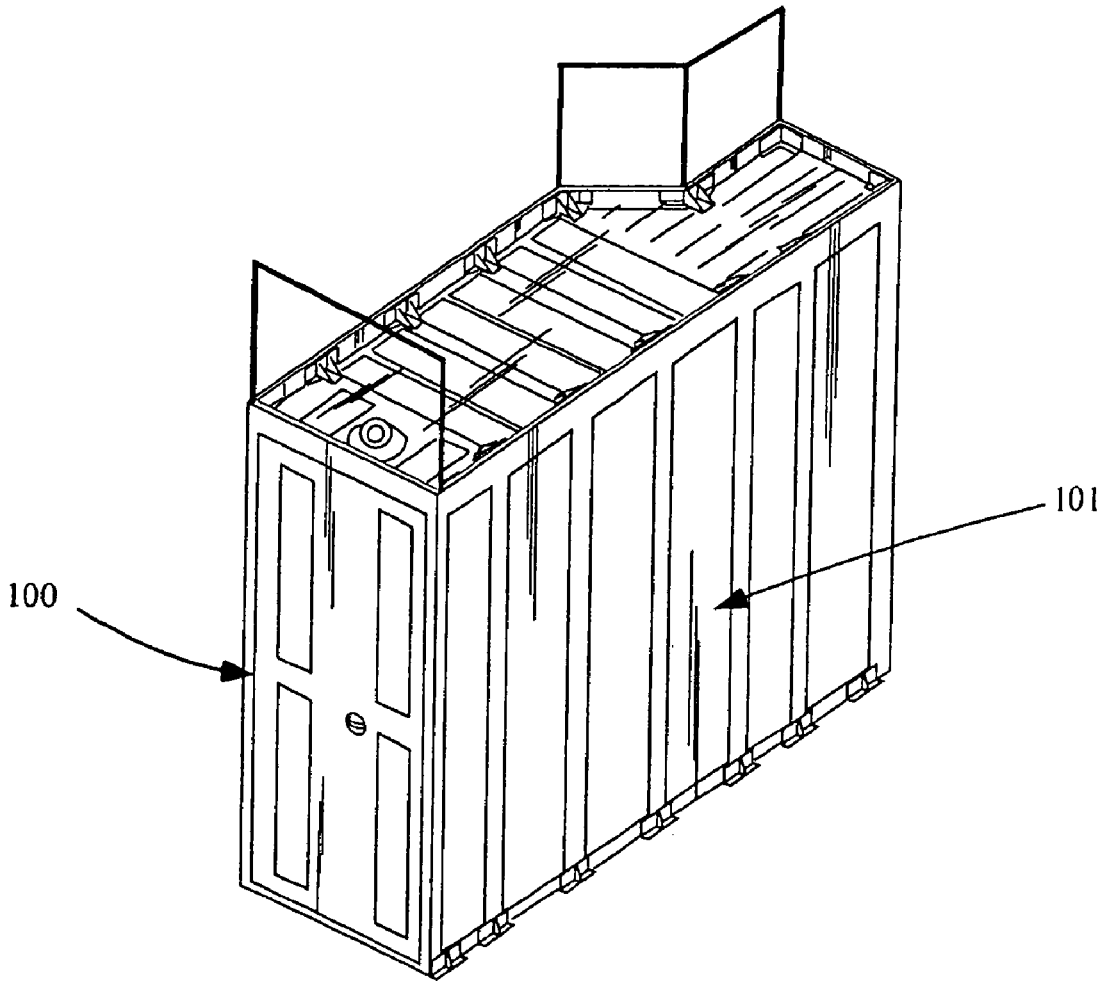
FIG. 1 is an isometric view of a bi-fold door in accordance with the present invention.

Referring to FIG. 1, shown is an isometric view of a bi-fold door in accordance with the present invention. Shown is the bi-fold door 100 and a main deck enclosure 101.

The bi-fold door 100 is connected to the main deck enclosure 101. In one embodiment, the main deck enclosure 101 encases a stairwell leading from a passenger compartment of an airplane to a low storage compartment of the airplane. The bi-fold door 100 is connected to the main deck enclosure 101 at an end closest the top of the stairwell. In other embodiments of the present invention, the bi-fold door 100 can be separating two different areas of the airplane on the same level of the airplane. In these embodiment, the main deck enclosure 101 is not encasing a stairwell and may not be required because only a fire wall is separating the two areas of the airplane.

In one embodiment of the present invention, the bi-fold door 100, also referred to herein as the door 100, provides access from the passenger compartment of an airplane, e.g., a BOEING 747, to a lower level, e.g., a cargo compartment of the airplane. The bi-fold door 100 provides access to the lower level and the main deck enclosure 101 encloses the stairwell to the lower level. The bi-fold door 100 provides a smoke and flame barrier between the two areas of the airplane. In accordance with another aspect of this embodiment, the bi-fold door 100 provides a smoke and flame barrier without creating a trip hazard between the two areas of the airplane.

Figure 2:
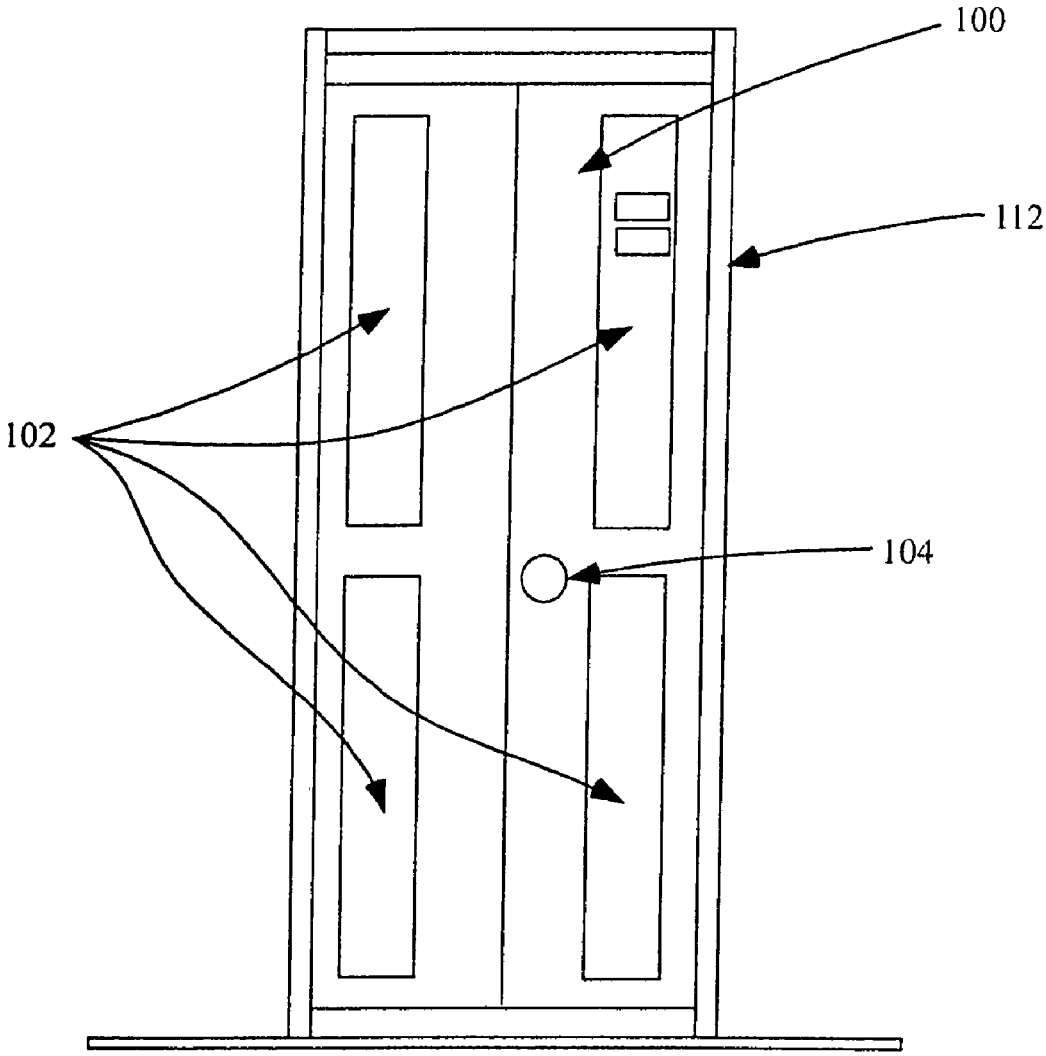
FIG. 2 is a front view of the bi-fold door shown in FIG. 1.

Referring next to FIG. 2 shown is a front view of the bi-fold door of FIG. 1. Shown is the bi-fold door 100, a door frame 112, a door handle 104, and a plurality of decompression panels 102.

The bi-fold door 100 is connected to the doorframe 112 in any known means as will be apparent to one of ordinary skill in the art. The bi-fold door has a left half and a right half with each half containing two of the plurality of decompression panels. The door handle 104 is connected to the right side of the bi-fold door.

The door 100 is shown in a closed position. In the present embodiment, the bi-fold door will open out toward a user as they pull on the door handle 104. As the door opens outward, it will also slide toward a left side of the door frame, thus allowing for the user to pass through the bi-fold door 100. Such operation of a bi-fold door 100 should be apparent to one of ordinary skill in the art.

The plurality of decompression panels 102 are a feature of the bi-fold door 100 that prevent structural damage to the structure of the stairway enclosure in the case of a decompression incident. When there is a decompression incident in a lower lobe of the airplane, the plurality of decompression panels 102 will disengage from the bi-fold door 100 to allow a rapid equalization of air pressure between the lower lobe and the main deck of the airplane. The disengagement prevents structural damage to the stairway enclosure.

Figure 3:
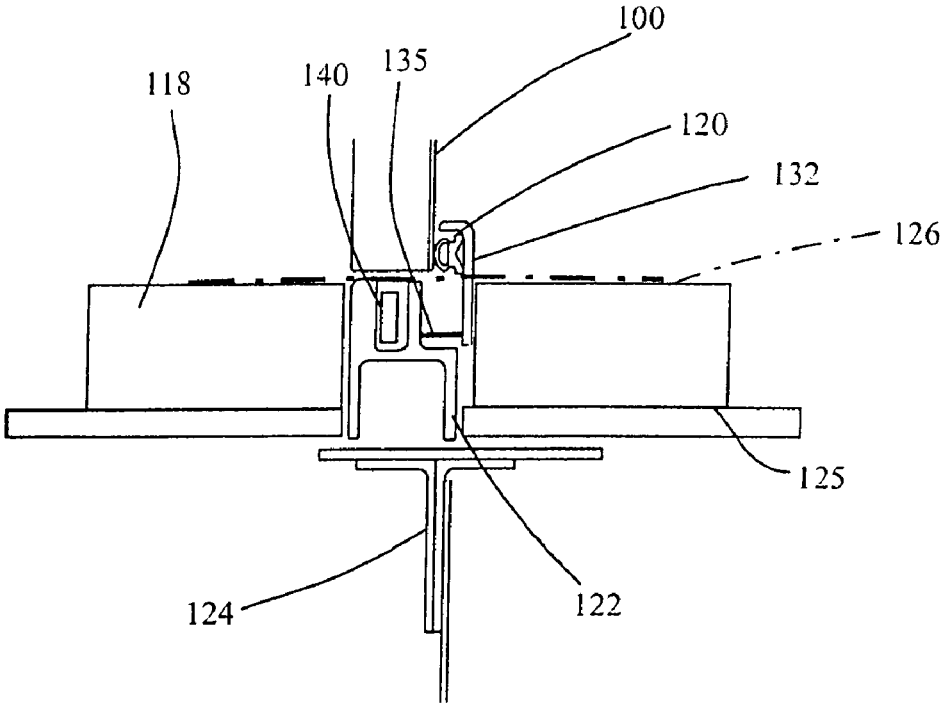
FIG. 3 is a partial side cross-sectional view of the sealing mechanism for the bi-fold door shown in FIG. 1 with the bi-fold door in the closed position.

Referring next to FIG. 3 shown is a partial side cross-sectional view of a sealing mechanism for the bi-fold door 100 shown in FIG. 1. The door 100 is shown in the closed position. Shown is the door 100, carpet 118, a bottom seal 120, a threshold 122, a floor beam 124, a ground 125, a ground plane 126, a seal assembly 132, a vertical slot pin 135, and a transfer bar 140.

The threshold 122 is made of machined aluminum and is coupled to the floor beam 124. The transfer bar 140 is positioned in a slot in the threshold 132. The seal assembly 132 is coupled to the threshold through a plurality of vertical slot pins 135 (only one shown in FIGS. 5 and 6). The bottom seal 120 is coupled to the seal assembly 132. As shown, the door 100 is in a closed position with the bottom seal 120 pressed up against the door 100. The bottom seal 120 is shown compressed. This provides a smoke barrier at the bottom of the door 100 when the door 100 is in the closed position. The carpet 118 is also shown laying on the ground 125 on either side of the threshold 122. The carpet 118 extends up to the sides of the threshold 122. The top of the carpet 118 creates the ground plane 126 shown by the dashed line. In one embodiment, as shown, a top of the threshold 122 is level with the ground plane 126.

In accordance with a preferred embodiment the top of the threshold 122 is even with the ground plane 126 thus providing for a level surface through the doorway. This prevents the threshold in the doorway from becoming a trip hazard for anyone passing through the doorway.

The door 100 is shown in the closed position with the bottom seal 120 pressed up against the door 100. The bottom seal 120 is above the level of the ground plane. This allows the bottom seal 120 to contact the bottom of the door 100 and provide a smoke barrier at the bottom of the door.

In a preferred embodiment the bottom seal 120 is a bulb seal wrapped in a flexible fire resistant fabric. Thus, the bottom seal 120 provides a smoke barrier when the door 100 is closed because of the pressure between the door and the bottom seal and provides a flame barrier because of the flexible fire resistant fabric.

The seal assembly 132 is made from corrosion resistant steel. This further provides a flame barrier between the floor and the door 100. The seal assembly 132 can be made from other materials while still providing a flame barrier.

Figure 4:
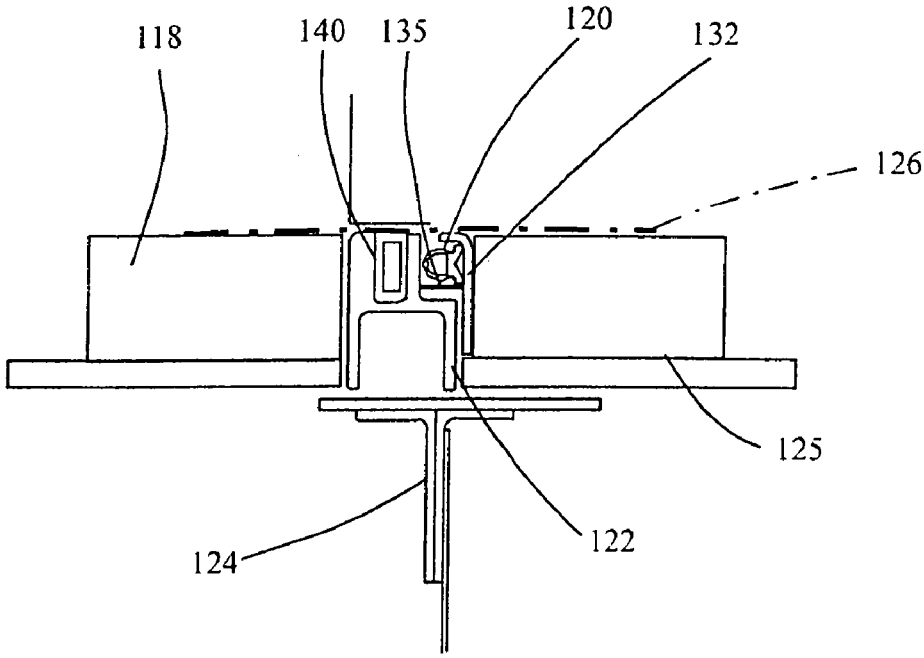
FIG. 4 is a partial side cross-sectional view of the sealing mechanism for the bi-fold door shown in FIG. 1 with the bi-fold door in the open position.

Referring next to FIG. 4 shown is a partial side cross-sectional view of the sealing mechanism for the bi-fold door shown in FIG. 1. The bi-fold door 100 in the open position.

The threshold 122 is coupled to the floor beam 124. The floor beam 124 is coupled to the ground 125. The carpet 118 is shown laying on the ground 125 on either side of the threshold 122. The carpet 118 extends up to the sides of the threshold 122. The top of the carpet 118 creates the ground plane 126 shown by the dashed line. In one embodiment, as shown, a top of the threshold 122 is level with the ground plane 126. The transfer bar 140 is positioned in a slot in the threshold 132. The seal assembly 132 is coupled to the threshold through a plurality of vertical slot pins 135 (only one shown in FIGS. 3 and 4). The bottom seal 120 is coupled to the seal assembly 132. As shown, the door 100 is in a open position and the bottom seal 120 and seal assembly 132 retracted downward toward the floor beam 124. The bottom seal 120 is shown decompressed because it is not pressed up against the door 100.

When the door 100 is in the open position, thus allowing a person to pass through the door 100, the bottom seal 120 and the seal assembly 132 are retracted down below the ground plane thus providing for a level surface through the doorway. This prevents the bottom seal 120 and the seal assembly 132 from becoming a trip hazard for anyone passing through the doorway. This operation will be further described herein with reference to FIGS. 5–10.

In accordance with a preferred embodiment, the seal assembly 132 retracts to be even with the ground floor 126. In other embodiments, the seal assembly can retract such that it is below the ground floor 126. In yet another embodiment, the seal assembly can retract such that it may be slightly above the ground floor, so long as it does not provide a trip hazard for anyone passing through the doorway. Similarly, the threshold 122 need not be level with the ground floor 126, so long as it does not provide a trip hazard.

In accordance with another embodiment of the present invention the bottom seal 120 is connected to the bottom of the door 100. In this embodiment, the seal assembly 132 is still coupled to the threshold 122 by the plurality of vertical slot pins 135 and the seal assembly 132 still retracts downward when the door 100 is opened. In this embodiment the bottom seal 120 may be segmented so as to fold properly when the bi-fold door 100 is opened. In this embodiment, the bottom seal 130 moves with the door 100 as it opens and closes. As the door 100 closes, the seal assembly 132 rises upward from the threshold 122. The bottom seal 120, which is attached to the bottom of the door 100 presses up against the seal assembly 132 compressing the bottom seal 120 and forming a smoke barrier at the bottom of the door 100. The bottom seal 120 forms the smoke barrier because the bottom seal 120 in a relaxed position overlaps the position at which the surface of the seal assembly is when the door 100 is in a closed position forcing the bottom seal 120 into compression. The force needed to compress the bottom seal 120 is provided by closing the door 100.

One prior design provides for a door frame that contacts the door only on the top and two sides of the door. In this design, the seal is attached to the doorway. This leaves the bottom of the door without a proper seal. In order to address this problem a movable seal was attached to the door and as the door closed the movable seal would move downward and contact a threshold in the ground. In this design, the mechanism that moved the seal downward also need to provide the force for seal compression as the door needed to be substantially closed and above the threshold before the seal could move down and contact the threshold.

Advantageously, in accordance with the present embodiments, when the door 100 closes, the movement of the door 100 provides the necessary force against the bottom seal 120, the side seal 130 (shown in FIG. 11) and the top seal 180 (shown in FIG. 13) such that they are sufficiently pressed against the door 100. In prior designs where a movable door sealing mechanism was attached to the door, the movable seal mechanism could not move downward until the door was substantially closed or it would drag on the ground. A separate mechanical means was needed to provide the compression force for the seal, as the door was already substantially closed, thus, the movement of the door could not provide the compression force. Thus, in accordance with the present embodiments, the seal assembly 132 rises out of the floor as the door 100 is closing to meet up with the bottom edge of the door 100 an form a seal. Advantageously, the closing of the door 100 will provide the necessary force for providing a seal that creates a smoke tight barrier. Additionally, the bottom seal 120, the side seal 130 and the top seal 180 are wrapped in a flexible fire resistant fabric. Thus, the pressure between the door 100 and the seals provides the smoke tight barrier and the flexible fire resistant fabric provides a flame barrier between the two sides of the door 100.

Figure 5:
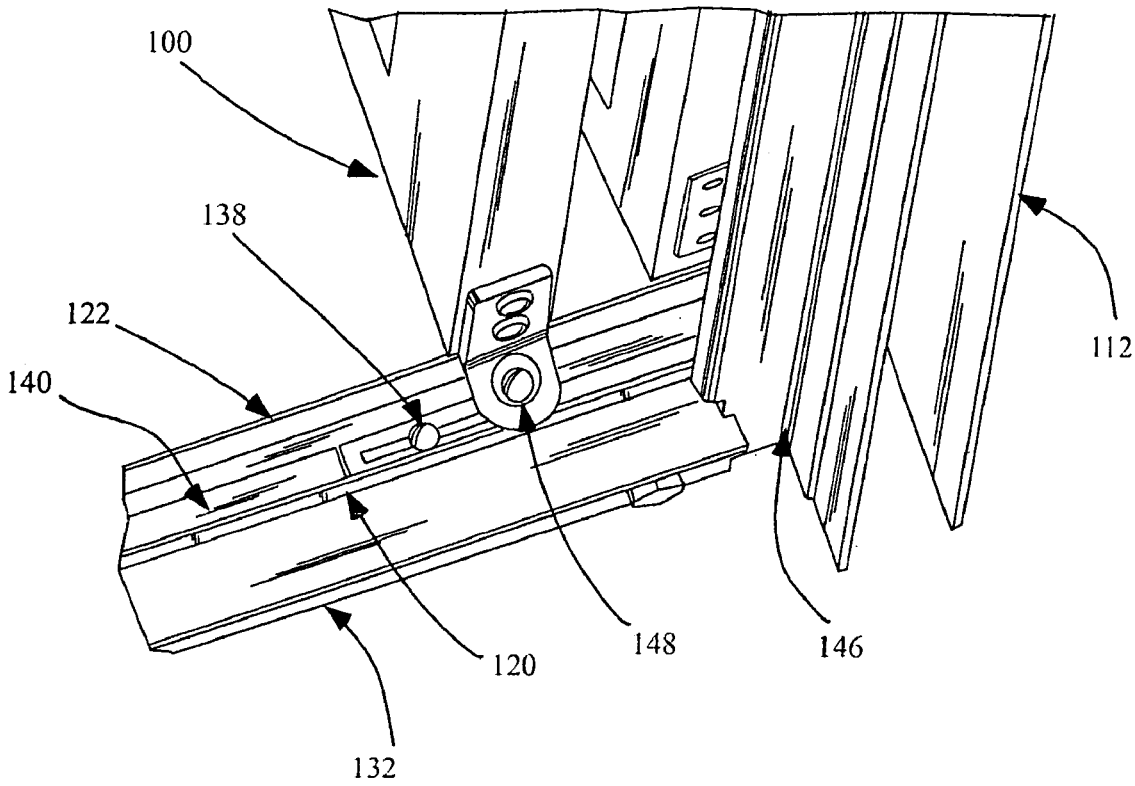
FIG. 5 is a partial isometric view of the sealing mechanism and the bi-fold door shown in FIG. 1.

Referring next to FIG. 5 shown is a partial isometric view of the sealing mechanism and the bi-fold door shown in FIG. 1. Shown is the door 100, the bottom seal 120, the seal assembly 132, the threshold 122, the transfer bar 140, a transfer bar bracket 138, the seal closeout 146, a door track pin bracket 148, and the door frame 112. The door 100 is shown in the open position with the bottom seal 120 and the seal assembly 132 retracted so as not to provide a trip hazard for anyone passing through the doorway.

The door 100 is connected to the door track pin bracket 148 by any known attachment means, e.g., a screw. The door 100 is attached to the door frame 112. The threshold 122 is also coupled to the door frame 112. The door track pin bracket 148 is positioned in a slot of the threshold 122. The transfer bar 140 is coupled to the transfer bar bracket 138. The transfer bar 140 and the transfer bar bracket 138 are also positioned in the slot of the threshold 122.

The transfer bar 140 is positioned in a slot of the threshold 122, such that it can freely slide inside the slot. As the door 100 opens, the door track pin bracket 148 catches on the transfer bar bracket 138. This causes the transfer bar 140 to move horizontally within the slot in the threshold 122. The vertical motion of the transfer bar 140 then causes the bottom seal 120 and the seal assembly 132 to retract, i.e., move vertically downward, thus preventing the bottom seal 120 and the seal assembly 132 from being a trip hazard for anyone using the door.

Figure 6:
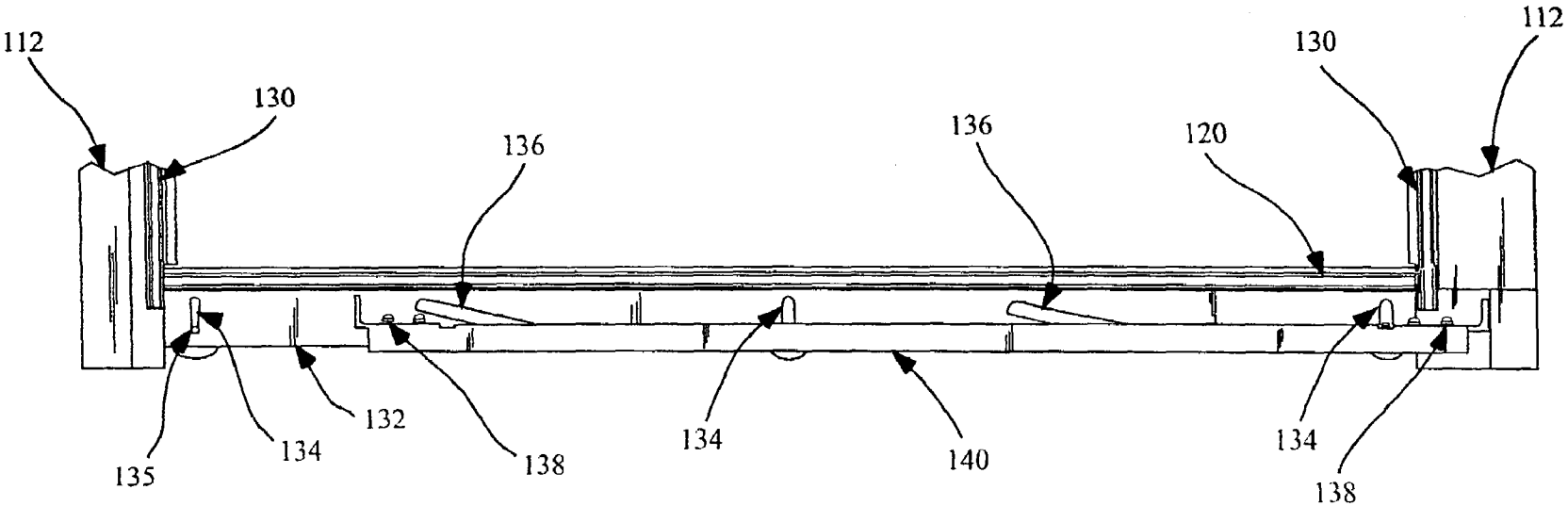
FIG. 6 is a cross-sectional view of the sealing mechanism for the closed bi-fold door shown in FIG. 1.

Referring next to FIG. 6 shown is a cross-sectional view of the sealing mechanism for the bi-fold door 100 shown in FIG. 1. FIG. 6 illustrates the position of the bottom seal when the door 100 is closed. Shown is the door frame 112, the bottom seal 120, the side seal 130, the seal assembly 132, a plurality of vertical slots 134 in the seal assembly 132, the plurality of vertical slot pins 135, the transfer bar 140, a plurality of transfer bar brackets 138, and a plurality of slide slots 136. The threshold 122 is not shown in FIG. 8 in order to show more clearly the transfer bar 140 and the seal assembly 132.

The seal assembly 132 includes a plurality of slide slots 136. In a preferred embodiment the slide slots are angled on the seal assembly 132 at a ten degree angle from horizontal. In other embodiments, the slide slots 136 may be angled at different angles from horizontal. The seal assembly 132 also includes the plurality of vertical slots 134. The plurality of vertical slot pins 135 couple ride in the vertical slots 134 and couple the seal assembly 132 to the threshold 122 (not shown).

In operation, the vertical slots 134 allow the seal assembly to retract when the door 100 is open. The vertical slots help prevent the seal assembly 132 from moving horizontally and also help prevent the seal assembly 132 from having any rotational movement.

As the door 100 is opened, the door track pin bracket 148, shown in FIG. 5, will catch on the transfer bar bracket 138 nearest the left side of the door frame 112. As the door 100 continues to open, the transfer bar 140 will move horizontally to the left. The transfer bar 140 includes a plurality of transfer bar slide pins 142 (shown in FIG. 8) that are coupled to the seal assembly 132 and ride in the plurality of slide slots 136. As the door opens the transfer bar 140 moves horizontally to the left and the plurality of transfer bar slide pins 142 also move horizontally to the left. This causes the vertical motion of the seal assembly 132 because the plurality of slide slots 136 are angled, e.g., ten degrees from horizontal. As the transfer bar slide pins 142 move horizontally to the left, the seal assembly 132 must move downward in order for the transfer bar slide pine 142 to stay in the slide slots 136. Thus, as the door 100 opens the seal assembly 132 is retracted below the ground plane 126.

The transfer bar bracket 138 is attached to the transfer bar with two screws. Other attachment means may be used in accordance with the embodiments herein. The two screws allow for the transfer bar bracket 138 to be adjusted slightly to the left or right. This allows for the door 100 to catch on the transfer bar bracket 138 sooner or later during the opening or closing of the door 100. This causes the horizontal movement of the transfer bar 140 to occur sooner or later depending upon the movement of the transfer bar bracket 138. This also causes the seal assembly 132 to retract sooner or later as the door 100 is opening depending upon the adjustment of the transfer bar bracket 138.

Figure 7:
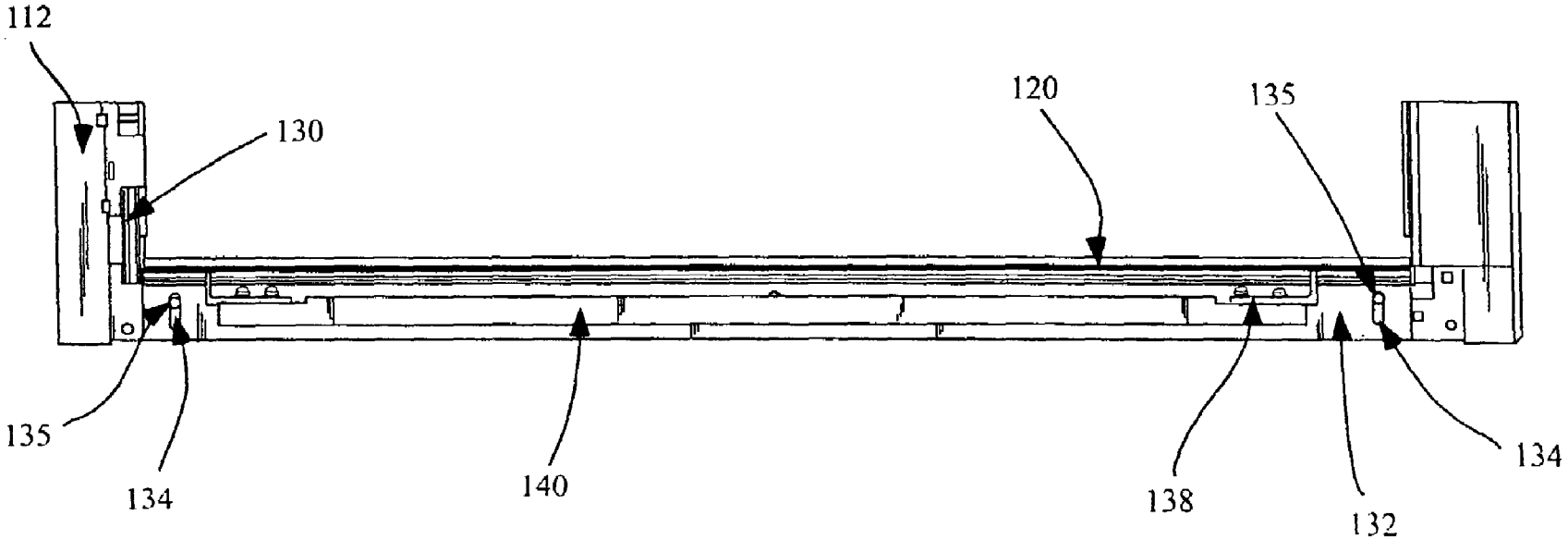
FIG. 7 is a cross-sectional view of the sealing mechanism shown in FIG. 6 for the bi-fold door in an open position.

Referring next to FIG. 7 shown is a cross-sectional view of the sealing mechanism shown in FIG. 6. FIG. 7 illustrates the position of the bottom seal 120 and seal assembly 132 when the door 100 is open. Shown is the door frame 112, the bottom seal 120, the seal assembly 132, the side seal 130, the plurality of vertical slots 134 in the seal assembly 132, the plurality of vertical slot pins 135, the transfer bar 140, and a plurality of transfer bar brackets 138.

The transfer bar 140 is positioned to the left as compared to the position of the transfer bar 140 in FIG. 6. Additionally, the seal assembly 132 is lower as compared to the position of the seal assembly 132 in FIG. 6. The vertical slot pins 135 which are coupled to the threshold 122 are now shown at the top of the vertical slots 134 in the seal assembly 132 corresponding to the seal assembly 132 being retracted.

In operation, as the transfer bar 140 moves inside of the slot in the threshold 140, the transfer bar slide pins 142 that are positioned to ride in the plurality of slide slots 136 force the seal assembly 132 to move downward.

Figure 8:
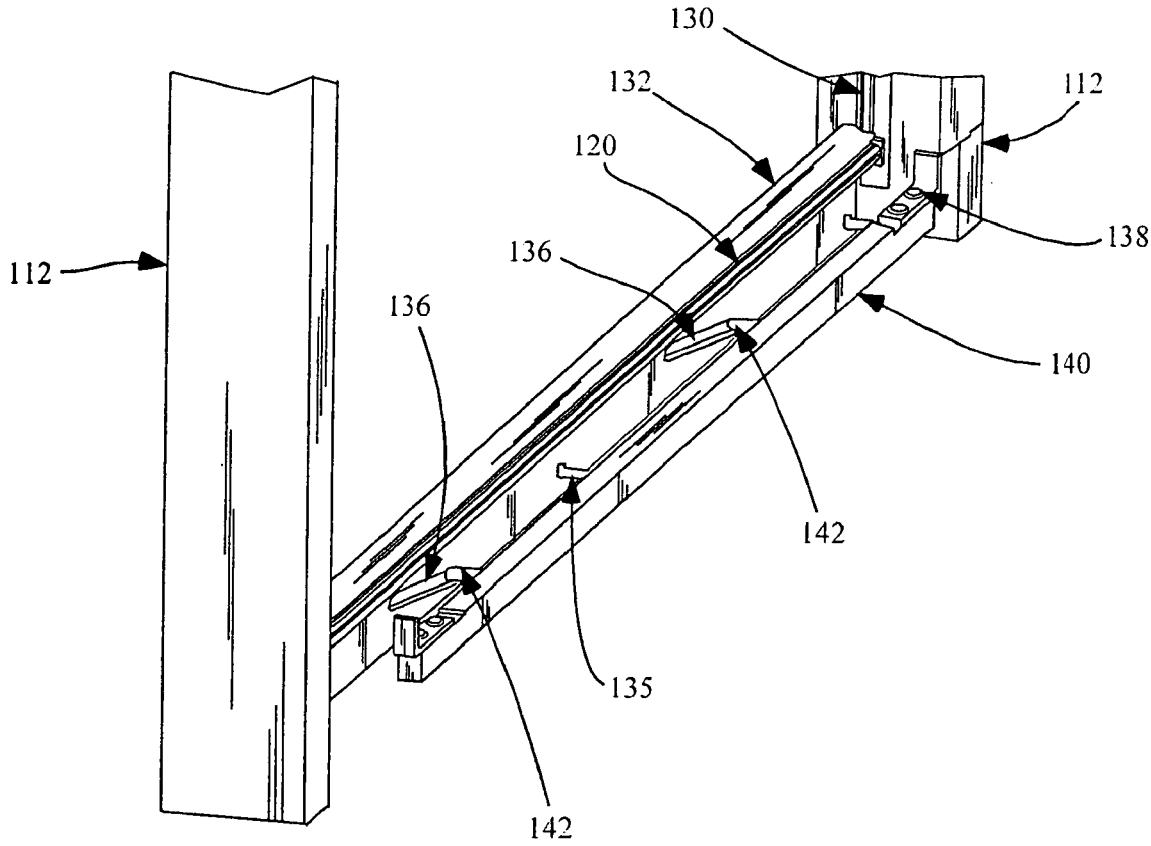
FIG. 8 is an isometric view of the sealing mechanism shown in FIG. 6 for the bi-fold door in a closed position.

Referring to FIG. 8 shown is an isometric view of the sealing mechanism shown in FIG. 6. The sealing mechanism is shown for the door 100 in a closed position. Shown is the door frame 112, the bottom seal 120, the seal assembly 132, the plurality of vertical slot pins 135, the transfer bar 140, the plurality of transfer bar brackets 138, the plurality of slide slots 136, and the plurality of transfer bar slide pins 142.

The plurality of transfer bar slide pins 142 are coupled to the transfer bar 140. The transfer bar slide pins 142 ride in the plurality of slide slots 136 in the seal assembly 132. The plurality of slide slots 136 are angled at ten degrees from horizontal, however, this angle can be greater or less than ten degrees in accordance with the present embodiments. The threshold 122 is not shown in FIG. 10, however, as described above, the transfer bar 140 slides in a slot in the threshold 122. Additionally, the threshold 122 is positioned between the transfer bar 140 and the seal assembly 132. Thus, the plurality of transfer bar slide pins 142 pass through the threshold 122 in order to fit into the plurality of slide slots 136 in the seal assembly 132. The threshold 122 includes one or more horizontal slots so that the transfer bar slide pins 142 can pass through the threshold 122 and fit into the plurality of slide slots 136.

The one or more horizontal slots in the threshold 122 need to be long enough to provide for sufficient movement of the transfer bar 140 such that the seal assembly 132 fully retracts and protrudes during the opening and closing of the door 100. Alternatively, one long horizontal slot may be provided along the substantially all of the length of the threshold 122.

The plurality of slide slots 136 are angled such that as the transfer bar 140 moves horizontally, the seal assembly 132 is forced to move vertically as the transfer bar slide pins 142 must stay in the plurality of slide slots 136. This provides one mechanism for retracting the seal assembly 132 such that it is not a trip hazard for anyone passing through the door 100. Other mechanisms may be used without deviating from the scope of the present invention.

Figure 9:
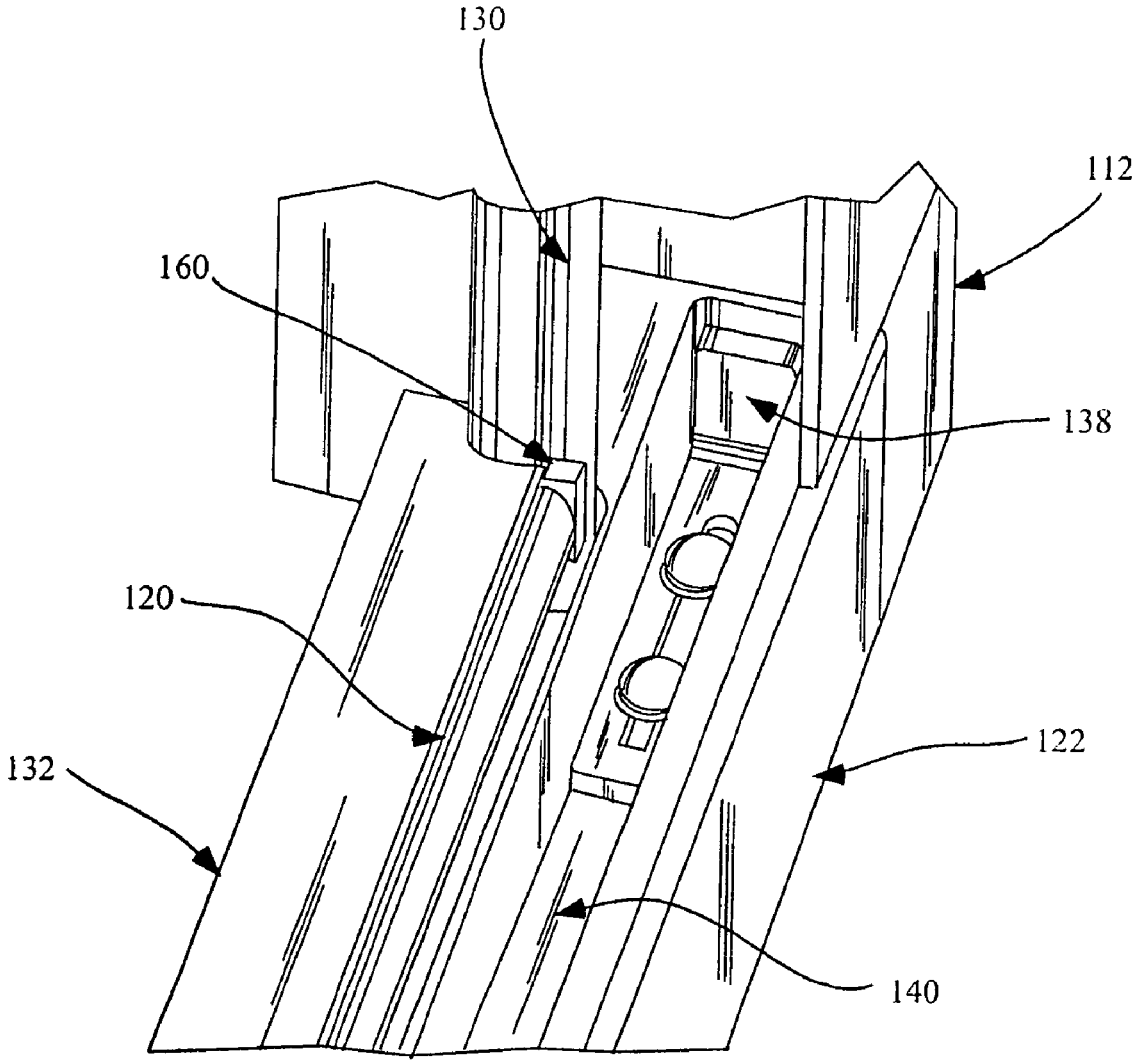
FIG. 9 is a partial isometric view of the sealing mechanism shown in FIG. 6 for the bi-fold door in a closed position.

Referring to FIG. 9 shown is a partial isometric view of the sealing mechanism shown in FIG. 6. The sealing mechanism is shown for the door 100 in the closed position. Shown is the door frame 112, the bottom seal 120, the seal assembly 132, the transfer bar 140, the plurality of transfer bar brackets 138, the side seal 130, the threshold 122, and the corner seal 160.

The corner seal 160 is placed between the bottom seal 120 and the side seal 130 such that no smoke with be able to pass through the doorway by going in between the bottom seal 120 and the side seal 130. The corner seal 160 can be a foam seal made from silicone sponge rubber. Many material can be used in accordance with other embodiments.

The transfer bar 140 is shown in the slot of the threshold 122 that allows the transfer bar 140 to move horizontally. Additionally, the two screws that attach the transfer bar brackets 138 to the transfer bar 140 are shown. As described previously, the screws allow for the adjustment of the transfer bar brackets 138.

Figure 10:
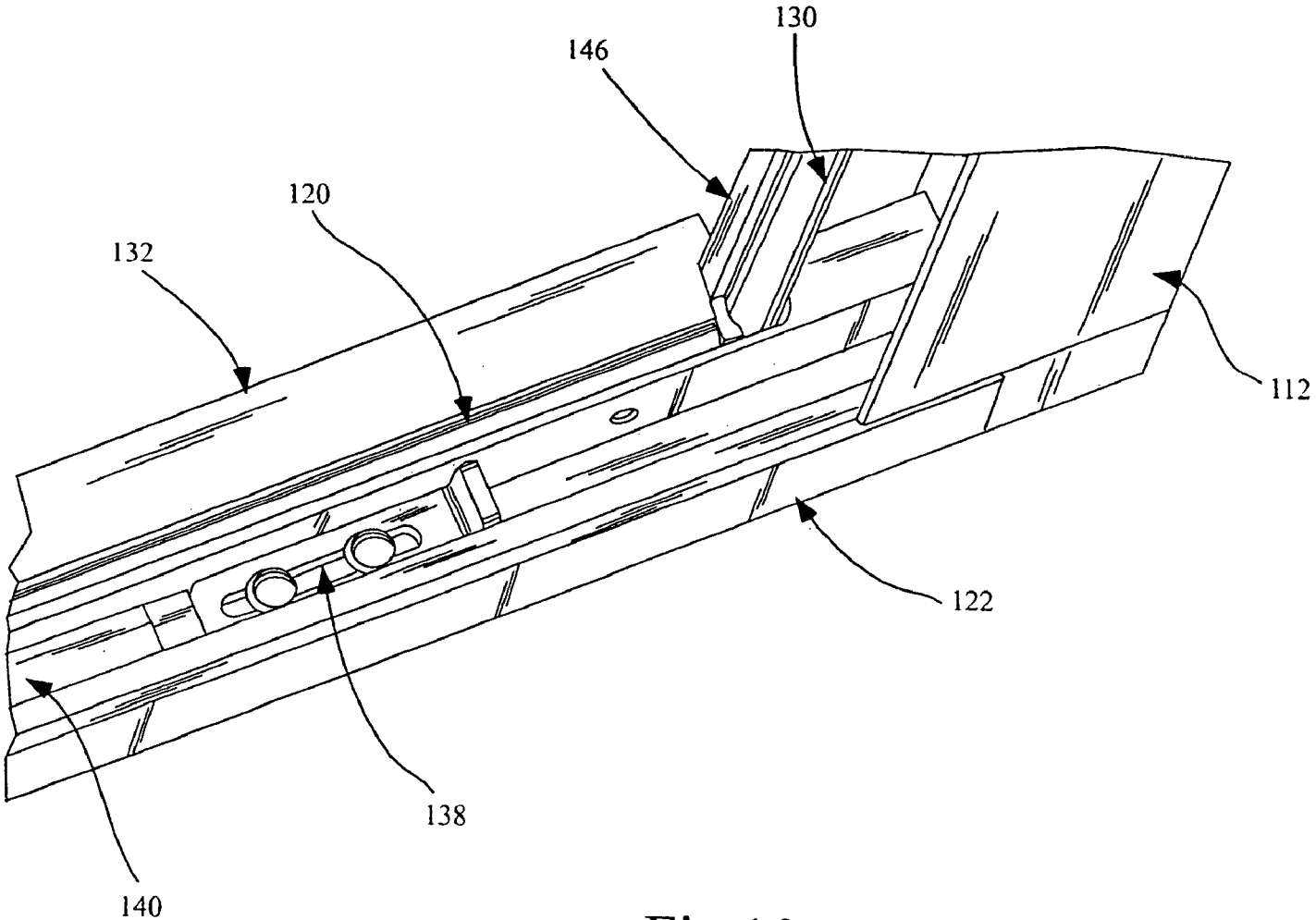
FIG. 10 is a partial isometric view of the sealing mechanism shown in FIG. 7 for the bi-fold door in an open position.

Referring to FIG. 10 shown is a partial isometric view of the sealing mechanism shown in FIG. 6. The sealing mechanism is shown in for the door 100 in the open position. Shown is the door frame 112, the bottom seal 120, the seal assembly 132, the transfer bar 140, the plurality of transfer bar brackets 138, the side seal 130, the threshold 122, and the corner seal 160.

The transfer bar 140 in a position corresponding to the door 100 in an open position. The transfer bar 140 has moved horizontally inside the slot in the threshold 122 as compared to the transfer bar 140 shown in FIG. 9. The horizontal movement of the transfer bar 140 causes the seal assembly 132 and the bottom seal 120 to move downward and even with the ground plane 126 such as is shown in FIG. 4.

Figure 11:
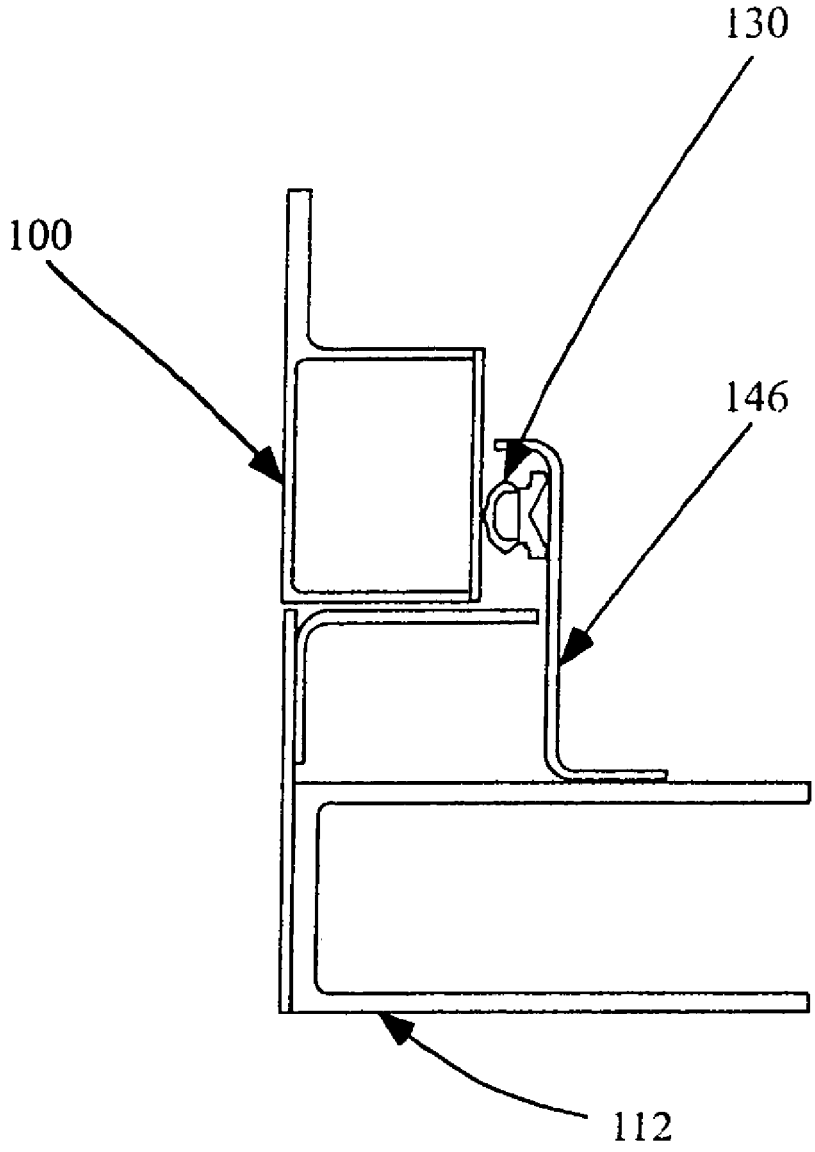
FIG. 11 is a partial top cross-sectional view of the bi-fold door and door frame shown in FIG. 1.

Referring next to FIG. 11 shown is a partial top cross-sectional view of the bi-fold door 100 and door frame 112 shown in FIG. 1. Shown is the door 100, a side seal 130, a seal closeout 146, and the door frame 112.

The door 100 is shown in a closed position with the side seal 130 pressed up against the door 100. The side seal 130 is connected to the seal closeout 146 which is then connected to the door frame 112. In a preferred embodiment the side seal 130 is a bulb seal, however, many other types of seals may be used with the present embodiment. The side seal 130 is wrapped in a flexible fire resistant fabric. The side seal 130 is shown in a compressed position.

The seal close out 146 provides a smoke and flame barrier between the door frame and the side seal 130. When the door is closed, the side seal 130 is pressed up against the door 100 which provides smoke and flame barrier between the door 100 and the side seal 130. Thus, the side seal 130 and the seal closeout 146 provide for a smoke and flame barrier along both sides of the door 100. The force of the door 100 against the side seal 130 causes the side seal 100 to compress slightly. This provides the smoke barrier between the door 100 and the seal 130. When the door 100 is in the closed position it provides a sufficient force against the side seal 130 such that smoke will generally not be able to pass between the door 100 and the side seal 130. When the door is in the open position, the force on the side seal 130 is relaxed. When the door 100 is in the open position there is no longer a need to provide a smoke barrier as the smoke can freely pass through the door way.

In one embodiment the seal closeout 146 is made from corrosion resistant steal in order to provide a flame barrier between the doorframe 112 and the door 100. Other materials may be used for the seal closeout 146 in order to provide the flame barrier.

Figure 12:
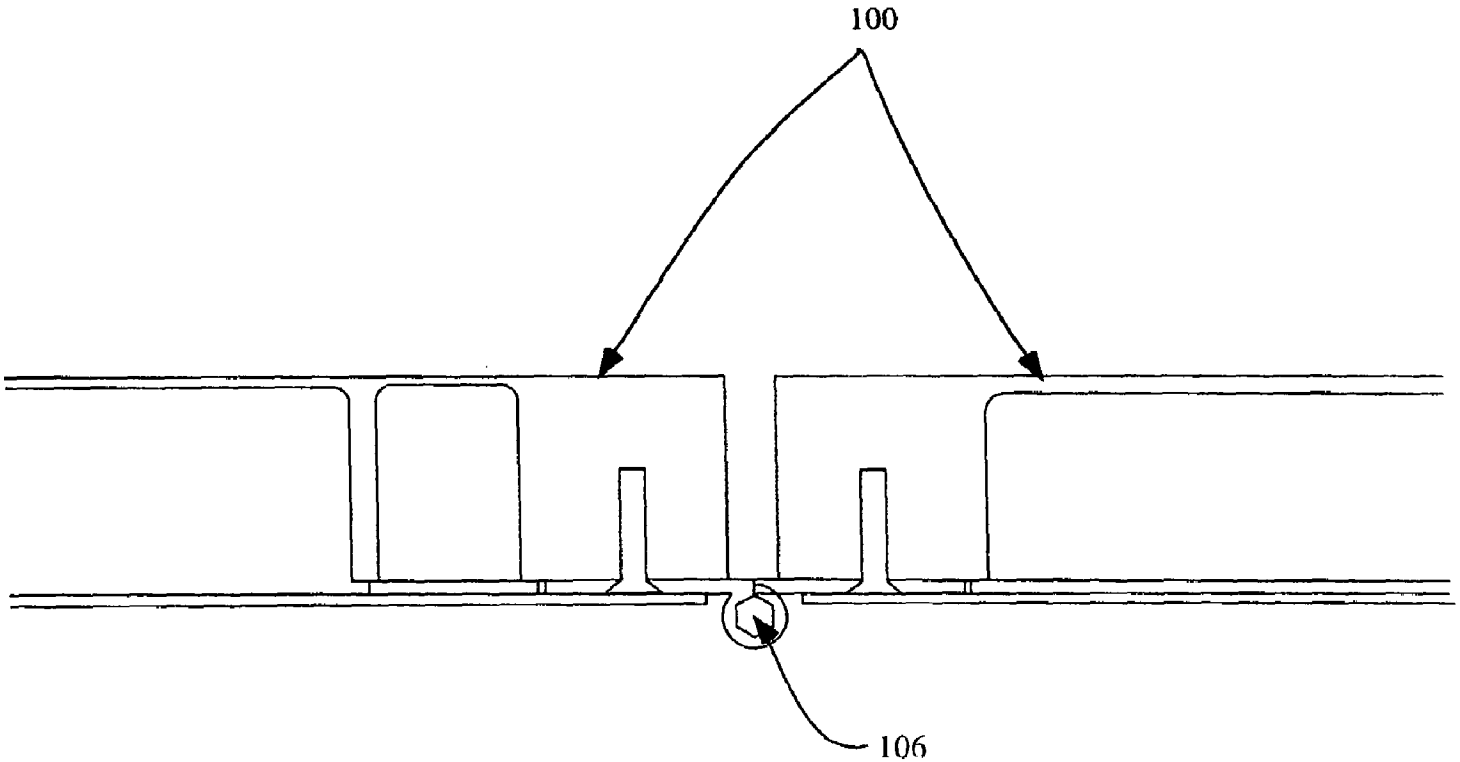
FIG. 12 is a top cross-sectional view of the bi-fold door shown in FIG. 1.

Referring next to FIG. 12 shown is a top cross-sectional view of the bi-fold door shown in FIG. 1. Shown is the bi-fold door 100 and a door hinge 106.

The door hinge 106 is coupled to the bi-fold door 100 through the use of any standard attaching means, e.g., a screw. The door hinge 106 is positioned on the opposite side of the bi-fold door 100 as the door handle 104 (shown in FIG. 2). The door hinge 106 attaches together two sections of the bi-fold door 100. In between the two half of the bi-fold door 100 where the door hinge 106 is located a flat seal is provided to prevent smoke and flame from traveling through the door. The flat seal is made from AMS3205 (Aerospace Material Specification 3205). Other materials may be used in other embodiments.

Figure 13:
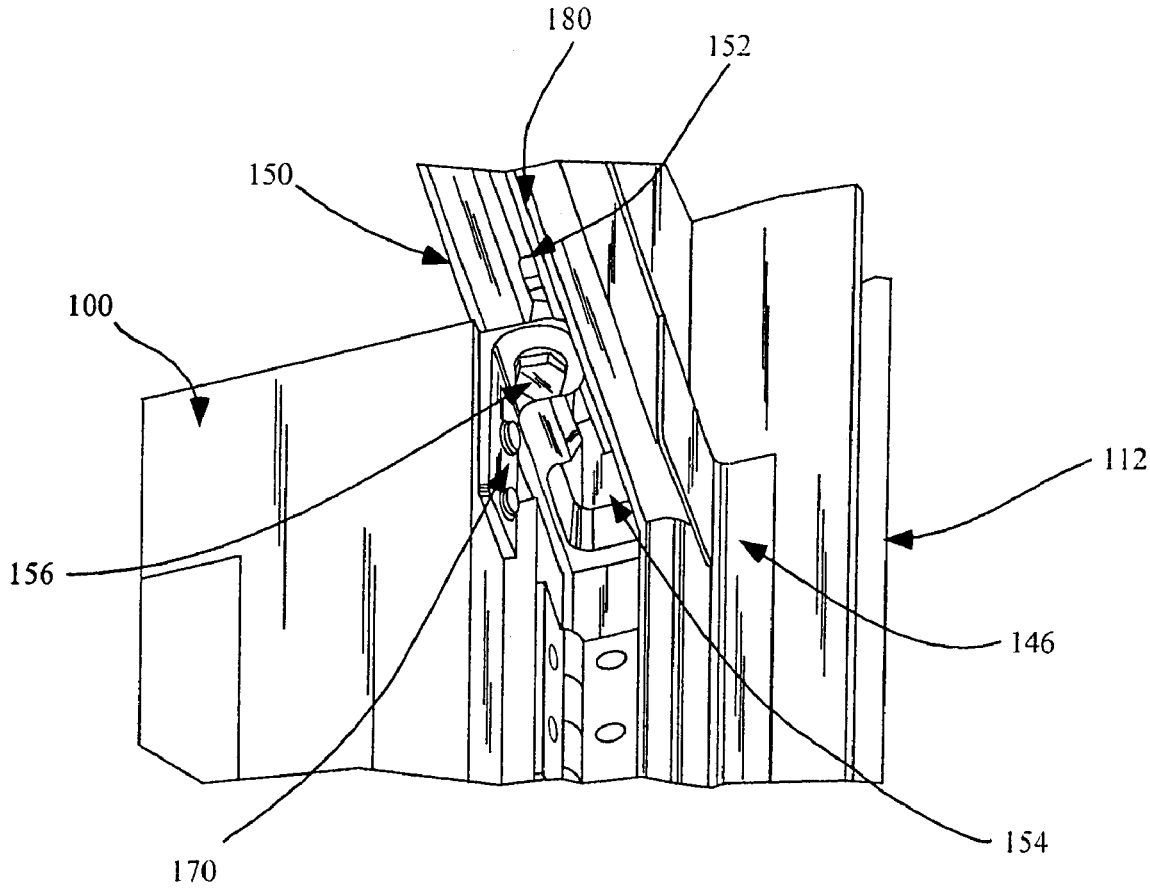
FIG. 13 is a partial isometric view of the top of the bi-fold door shown in FIG. 1.

Referring to FIG. 13 shown is a partial isometric view of the top of the bi-fold door shown in FIG. 1. The door 100 is shown in an open position. Shown is the door 100, an upper shoulder bolt 156, an upper door track 150, a slide block 152, an opening 154 to remove the slide block 152, the seal closeout 146, a top seal 180, a bracket 170 and the door frame 112.

The slide block 152 is coupled to the upper door track 150. The upper shoulder bolt 156 is coupled to the door 100 and slides in the slide block 152 within the upper door track 150 as the door 100 opens or closes. The opening 154 to remove the slide block 152 is provided such that the door 100 can be removed and replaced should it become damaged or need servicing. The slide track is made from machined aluminum.

The upper door seal 180 provides a seal at the top of the door 100 that prevents smoke from traveling through the doorway at the top of the door 100.

The upper door seal 180 and the side seal 130 together form a sealing mechanism. The sealing mechanism provides for a smoke tight barrier for the two sides of the door 100 and the top of the door 130. In one embodiment the sealing mechanism includes the side seal 130 for both sides of the door and a separate upper door seal 180 for the top of the door 100. In an alternative embodiment the sealing mechanism includes one continuous seal for both sides of the door and the top of the door 100. Additionally, the upper door seal 180 can be one continuous piece of material or can be a plurality of segmented sections. Similarly, the side seal 130 and the bottom seal 120 can be one continuous piece of material or can be a plurality of segmented sections.

Figure 14:
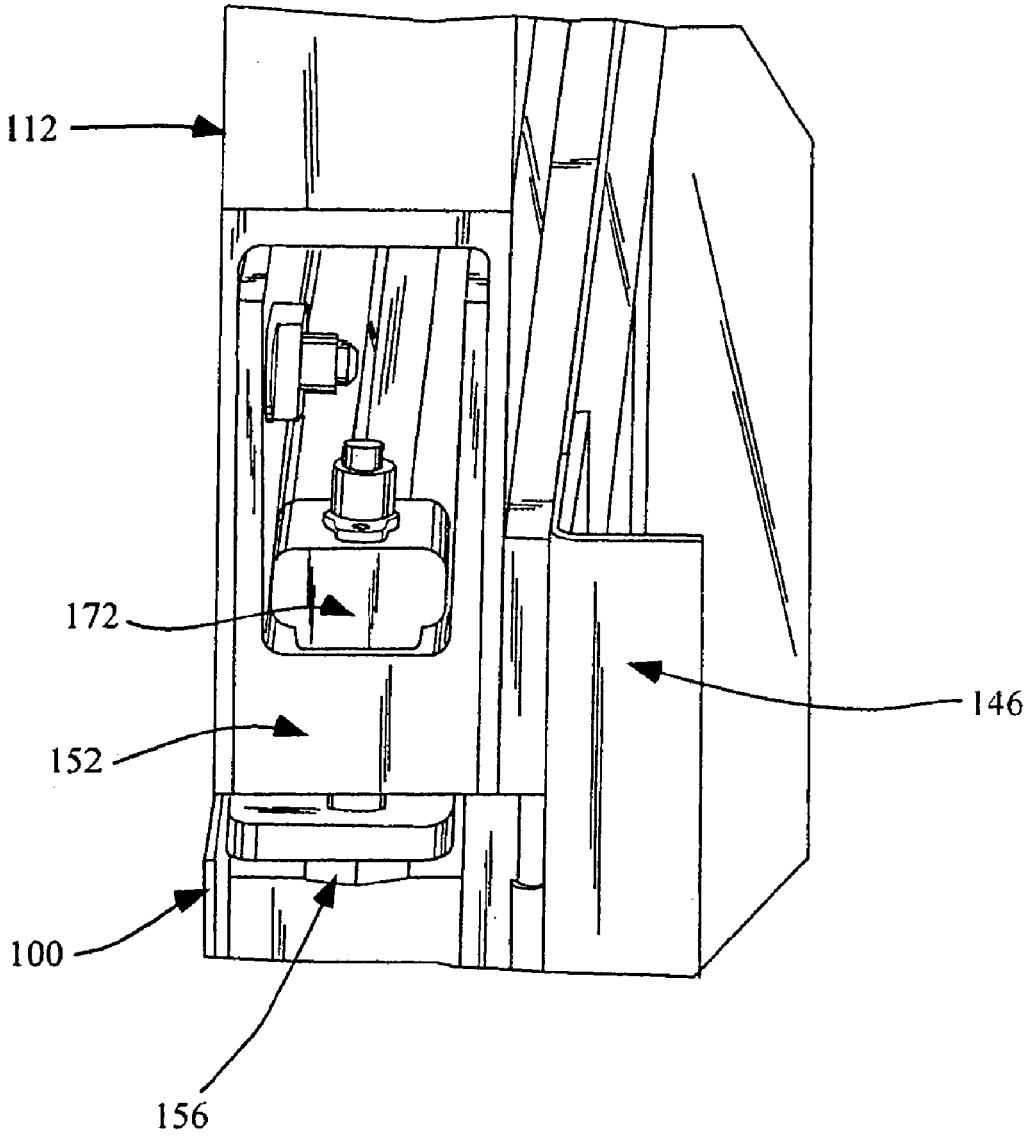
FIG. 14 is a partial isometric view of the top of the bi-fold door shown in FIG. 1.

Referring to FIG. 14 is a partial isometric view of the top of the bi-fold door shown in FIG. 1. Shown is the door 100, the door frame 112, the seal closeout 146, the slide block 152, the upper shoulder bolt 156, and a slide fitting 172. The door is shown in the closed position.

The slide fitting 172 is coupled to the slide bolt 156 that is coupled to the bracket 170 attached to the door 100. The slide fitting 172 allows the door to easily slide in the slide block 152, thus providing for the door to open and close.

Figure 15:
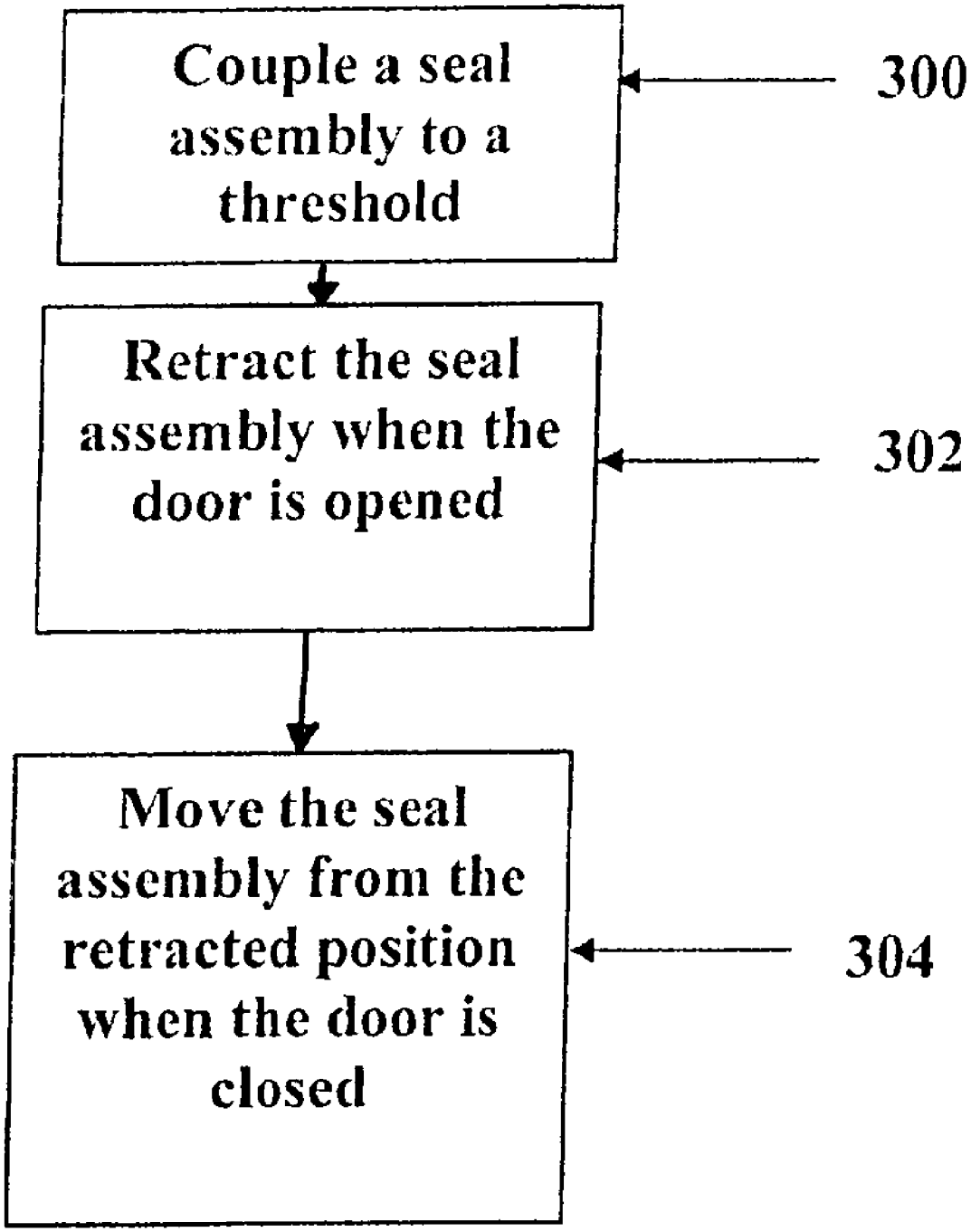
FIG. 15 is a flow diagram illustrating a method in accordance with the present invention.

Referring to FIG. 15, shown is a flow chart illustrating a method in accordance with the present invention.

First, in step 300 the seal assembly 132 is coupled to the threshold 122. The seal assembly 132 can be coupled though many mechanical means, e.g., such as is shown in FIGS. 5–10. Other coupling means may be used which create the vertical movement of the seal assembly 132.

Second, in step 302 the seal assembly 132 is retracted when the door 100 is opened so that it does not provide a trip hazard for anyone who may use the door.

Next, in step 304 the bottom seal is moved upward from the retracted position so that when the door 100 is closed the seal assembly 132 in combination with a bottom seal 120 provides a smoke and flame barrier at the bottom of the door 100. In accordance with the embodiments described herein, the bottom seal 120 may be coupled either to the door 100 or to the seal assembly 132.

While the invention herein disclosed has been described by means of specific embodiments and applications thereof, other modifications, variations, and arrangements of the present invention may be made in accordance with the above teachings other than as specifically described to practice the invention within the spirit and scope defined by the following claims.

We claim:

1. An apparatus for providing a smoke barrier through a doorway comprising:

a threshold below a door;

a movable seal assembly coupled to the threshold;

a slot in the movable seal assembly;

a transfer bar coupled to the threshold, wherein the transfer bar moves horizontally as the door is closed;

a pin coupled to the transfer bar and to the slot in the movable seal assembly;

a transfer bar bracket coupled to the transfer bar, wherein the transfer bar bracket engages a bracket coupled to the door as the door is closing to create the horizontal movement of the transfer bar;

a bottom seal coupled to the movable seal assembly;

a side seal coupled to a side of a doorframe; and a top seal coupled to a top of the doorframe;

wherein the movable seal assembly retracts towards the threshold as the door is opened;

wherein when the door is closed a smoke and flame barrier is provided between a first area and a second area;

wherein the slot in the movable seal assembly is at an angle greater than zero degrees from horizontal such that the horizontal movement of the transfer bar corresponds to the retraction of the movable seal assembly.

2. The apparatus of claim 1 wherein the bottom seal is a bulb seal.

3. The apparatus of claim 1 wherein the side seal and the top seal are bulb seals.

4. The apparatus of claim 1 wherein the door is a bi-fold door.

5. The apparatus of claim 1 wherein the movable seal assembly is retracted to be at least even with a ground plane.

6. The apparatus of claim 5 wherein a top of the threshold is substantially even with the ground plane.

7. An apparatus for providing a smoke barrier through a doorway comprising:

a bi-fold door coupled to a doorframe;

a threshold on the floor between the doorframe;

a movable seal assembly coupled to the threshold;

a slot in the movable seal assembly;

a transfer bar coupled to the threshold and the movable seal assembly, wherein the transfer bar includes a transfer bar bracket attached to a top of the transfer bar, wherein a bi-fold door bracket attached to the bi-fold door engages the transfer bar bracket upon closing of the bi-fold door causing the transfer bar to move horizontally;

a pin coupled to the transfer bar and to the slot in the movable seal assembly;

a sealing mechanism coupled to the doorframe for contacting a top and two sides of the bi-fold door when the bi-fold door is in the closed position; and a bottom seal coupled to the movable seal assembly for contacting a bottom of the bi-fold door when the bi-fold door is in the closed position;

wherein the slot in the movable seal assembly is at an angle greater than zero degrees from horizontal such that the horizontal movement of the transfer bar causes the movable seal assembly to react towards the threshold as the bi-fold door is opened;

wherein when the bi-fold door is closed a smoke and flame barrier is provided between a first area and a second area.

8. The apparatus of claim 7 wherein the sealing mechanism comprises:

a plurality of side seals coupled to the doorframe; and a top seal coupled to the doorframe.

9. The apparatus of claim 7 wherein the movable seal assembly retracts downward when the bi-fold door is opened.

10. The apparatus of claim 7 wherein the threshold is below a ground plane.

11. The apparatus of claim 10 wherein the movable seal assembly retracts below the ground plane when the bi-fold door is opened.

12. An apparatus for providing a seal at the bottom of a bi-fold door comprising:

a threshold located below the bi-fold door;

a transfer bar coupled to the threshold;

a movable seal assembly coupled to the transfer bar;

a slot in the movable seal assembly;

a pin coupled to the transfer bar and positioned to engage the slot in the movable seal assembly; and a transfer bar bracket attached to a top of the transfer bar, wherein a bi-fold door bracket attached to the bi-fold door engages the transfer bar bracket upon closing of the bi-fold door causing the transfer bar to move horizontally;

wherein the slot is at an angle greater than zero degrees from horizontal such that the horizontal movement of the transfer bar corresponds to the vertical movement of the movable seal assembly;

wherein the horizontal movement of the transfer bar causes the movable seal assembly to move vertically such that the movable seal assembly engages the bi-fold door.

13. An apparatus for providing a seal at the bottom of a bi-fold door comprising:

a threshold located below the bi-fold door;

a transfer bar coupled to the threshold;

a movable seal assembly coupled to the transfer bar;

a transfer bar bracket attached to a top of the transfer bar, wherein a bi-fold door bracket attached to the bi-fold door engages the transfer bar bracket upon closing of the bi-fold door causing the transfer bar to move horizontally; and an additional transfer bar bracket attached to the top of the transfer bar, wherein the bi-fold door bracket attached to the bi-fold door engages the additional transfer bar bracket upon opening of the bi-fold door causing the transfer bar to move horizontally upon opening the bi-fold door;

wherein the horizontal movement of the transfer bar causes the movable seal assembly to move vertically such that the movable seal assembly engages the bi-fold door.

14. The apparatus of claim 13 further comprising:

a slot in the movable seal assembly; and a pin coupled to the transfer bar and positioned to engage the slot in the movable seal assembly;

wherein the slot is at an angle greater than zero degrees from horizontal such that the horizontal movement of the transfer bar corresponds to the vertical movement of the movable seal assembly.

* * * * *